US007444762B2

(12) United States Patent
Reck et al.

(10) Patent No.: US 7,444,762 B2
(45) **Date of Patent: *Nov. 4, 2008**

(54) COMBINED TEMPERATURE SENSOR FOR CLOTHES DRYER

(75) Inventors: Andrew C. Reck, Watervliet, MI (US); Shawn R. Oltz, Niles, MI (US); Steven D. Ficke, St. Joseph, MI (US); Michele A. Paustian, Benton Harbor, MI (US); Christopher J. Woerdehoff, Sawyer, MI (US); Joshua P. Carroll, St. Joseph, MI (US); Mark E. Glotzbach, Mishawaka, IN (US); James P. Carow, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 55 days.

This patent is subject to a terminal disclaimer.

(21) Appl. No.: 11/077,840

(22) Filed: Mar. 11, 2005

(65) Prior Publication Data

US 2006/0201019 A1 Sep. 14, 2006

(51) Int. Cl.
*F26B 7/00* (2006.01)

(52) U.S. Cl. ..... 34/381; 34/602; 34/606

(58) Field of Classification Search ..... 34/380, 34/381, 446, 600, 602, 603, 605, 60, 606; 318/66

See application file for complete search history.

(56) References Cited

U.S. PATENT DOCUMENTS

| | | | | | |
|---|---|---|---|---|---|
| 3,132,004 | A * | 5/1964 | Horecky | 34/549 |
| 3,862,820 | A * | 1/1975 | Hantack | 431/66 |
| 4,397,101 | A | 8/1983 | Rickard | 34/30 |
| 4,510,778 | A * | 4/1985 | Cotton | 68/12.15 |
| 4,649,654 | A | 3/1987 | Hikino et al. | 34/30 |
| 5,006,778 | A * | 4/1991 | Bashark | 318/799 |
| 6,199,300 | B1 * | 3/2001 | Heater et al. | 34/446 |
| 6,373,032 | B1 | 4/2002 | Bruntz et al. | 219/494 |
| 6,968,632 | B2 * | 11/2005 | Guinibert et al. | 34/602 |
| 2003/0217481 | A1 | 11/2003 | Bruntz et al. | 34/557 |
| 2003/0230005 | A1 * | 12/2003 | Lapierre | 34/606 |

FOREIGN PATENT DOCUMENTS

| | | |
|---|---|---|
| GB | 2154721 | 9/1985 |

* cited by examiner

*Primary Examiner*—S. Gravini
(74) *Attorney, Agent, or Firm*—Clifton Green; Michael D. Lafrenz

(57) ABSTRACT

A clothes dryer has a system for regulating the inlet air temperature. The system includes a first sensor located in an inlet of the dryer and including a thermistor and a thermostat, a heat source located in a heater box adjacent the first sensor, and a second sensor located in an exhaust of the dryer. The thermistor measures the inlet air temperature of the dryer and cooperates with the controller to prevent the thermostat from reaching its trip temperature and turning off the heat source. Thus, damage due to excessive air temperatures in the dryer is prevented.

17 Claims, 4 Drawing Sheets

COMBINED TEMPERATURE SENSOR FOR CLOTHES DRYER

BACKGROUND OF THE INVENTION

1. Field of the Invention

The present invention relates generally to the drying of clothes using a clothes dryer. More particularly, the invention relates to providing a clothes dryer with a combined temperature sensor and electromechanical thermostat for measuring the inlet air temperature, and for controlling the heat source.

2. Description of Related Art

The drying of clothes via the application of heated air in a conventional clothes dryer is well-known in the prior art. Thermostats and thermistors with electronics are used in such dryers to control heat input, thereby preventing high clothes temperatures that can damage the clothes. Some dryers use both an inlet thermistor and an exhaust thermistor for monitoring air temperature, as well as a bi-metal thermostat for limiting the heat input. This known configuration, however, suffers from a number of shortcomings.

Initially, the above-mentioned system of the prior art has a delay between the time the inlet air temperature is sensed by the thermistor and the time the thermostat reacts to an increase in temperature. This delay in response time can result in excessively long drying times due to the thermostat turning the heating element off prematurely. This condition, known as nuisance cycling, lengthens the total amount of drying time necessary to completely dry the contents of the dryer.

Another shortcoming of the prior art is a lack of close correlation of the air temperature due to the distance and orientation between the inlet thermistor and the thermostat. This distance and orientation can lead to a difference in the temperature detected by each of the components.

Further, the prior art utilizes an inlet thermistor that is separate from the thermostat. Thus, two separate components must be manufactured and mounted to the dryer, thereby adding to the overall cost in both labor and materials.

Accordingly, it is desirable to develop a system that more efficiently controls the heat input in a clothes dryer while using the minimum amount of components to reduce overall cost.

SUMMARY OF THE INVENTION

The present invention meets the shortcomings of the prior art by providing a combined thermistor/thermostat located in the inlet of the heater box of a clothes dryer. The combined device measures the conductive, convective, and/or radiated heat of the heat source of the dryer and regulates the inlet air temperature to the clothes load, thereby providing a more real-time control of the overall dryer temperature and preventing the air temperature from getting too high. The invention disclosed herein combines a thermistor with its fast response time for monitoring inlet air temperature and a bi-metal thermostat wired directly to the heat source. One of the benefits of having a combined device is the close proximity of the two components. This proximity improves the reaction time of the control system to temperature changes, thereby preventing excessive fabric temperatures. The combined sensor of the present invention provides all the above benefits at a cost lower than that of prior art sensors since the thermistor and thermostat are assembled as a single piece instead of two separate components.

DETAILED DESCRIPTION OF THE PREFERRED EMBODIMENTS

Figure 1:
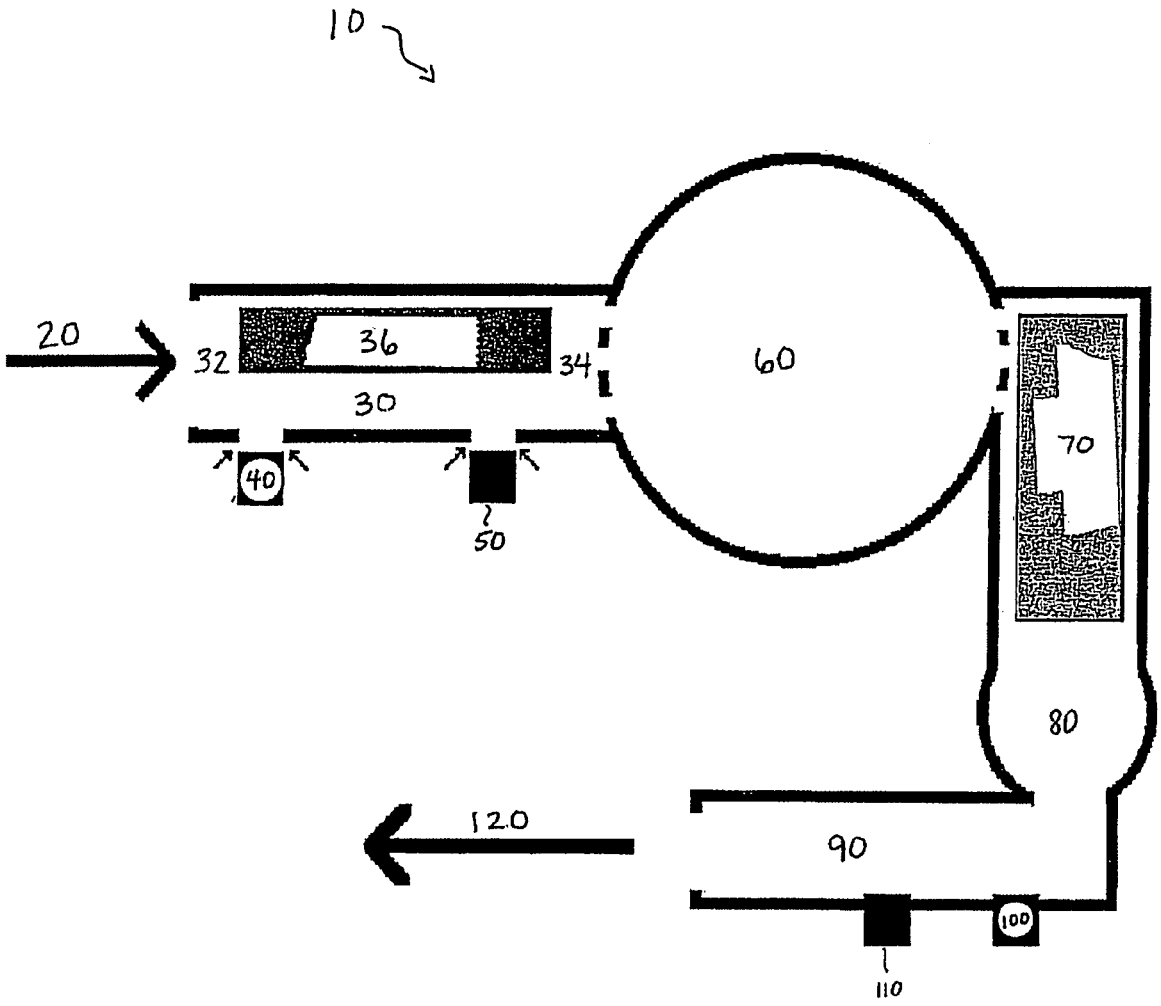
FIG. 1 is a schematic view of a system utilizing the combined thermistor/thermostat sensor of the present invention.

With reference to FIG. 1, an electric clothes dryer 10 of the present invention is schematically shown, provided generally with a heater box 30, a drum 60, a blower 80 and an exhaust 90. The heater box 30 is provided with an inlet 32 through which inlet airflow 20 passes, and a drum inlet grill 34 through which heated air exits the heater box 30 and enters the drum 60 of the dryer 10. The air is heated in the heater box 30 by a heating element 36, preferably a dual element heater. The blower 80 draws the air out of the drum 60, through a lint screen 70, and eventually through the exhaust 90 of the dryer, as exhaust airflow 120. The dryer 10 further includes a thermal cut-off 50 and a thermal fuse 110. The thermal cut-off 50 ensures a safe condition in the event of a heating element failure. The thermal fuse 110 removes power to the drum motor, thus stopping the airflow and containing any combustible material from being vented outside of the dryer.

Figure 2A:
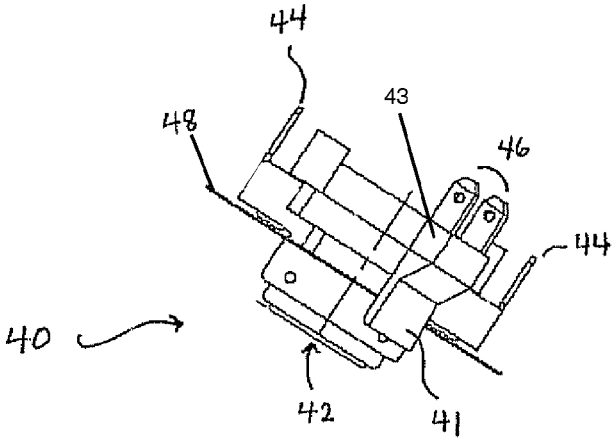
FIGS. 2A and 2B are perspective views of the combined thermistor/thermostat sensor of the present invention.
Figure 2B:
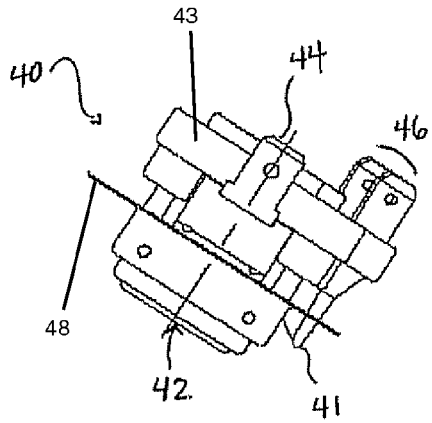

The clothes dryer 10 is provided with a number of sensors for detecting the temperature of the airflow in the dryer. A combined thermistor/thermostat unit 40 is located in the inlet 32 of the heater box 30 while an exhaust thermistor temperature sensor 100 is located in the exhaust 90 of the dryer 10. As shown in FIGS. 2A and 2B, the combined thermistor/thermostat unit 40 includes a thermistor temperature sensor 41 and an electromechanical bi-metal thermostat 42 within a body 43. The thermistor 41 measures the inlet air temperature of the dryer, and the exhaust thermistor 100 measures the temperature of exhaust airflow 120. The thermostat 42 opens the heating element circuit when the temperature exceeds a predetermined trip point and closes the heating element circuit when the temperature falls below a predetermined reset point.

The thermistor 41 of the combined sensor unit 40 may be a partially encapsulated NTC (negative temperature coefficient) semiconductor molded into a high temperature plastic probe. Alternatively, the thermistor 41 may be a fully encapsulated or metal enclosed device. The thermostat 42 may be of a bi-metal type single pole, single throw switch that opens when the metal is heated to the specified trip point. Thus, the combined unit 40 provides the fast response time of a thermistor along with the safety and reliability of a bi-metal thermostat within one component.

Referring to FIGS. 2A and 2B, the combined sensor unit 40 is depicted in further detail. In addition to the thermistor 41 and the thermostat 42, the unit is provided with high voltage terminals 44, which are connected in series with the heating element 36, and terminals 46 for connection with a controller. The high voltage terminal 44 and the terminal 46 protrude from the body 43. Further, the unit is provided with mounting means 48 for mounting in the desired location on the heater box 30.

Figure 3:
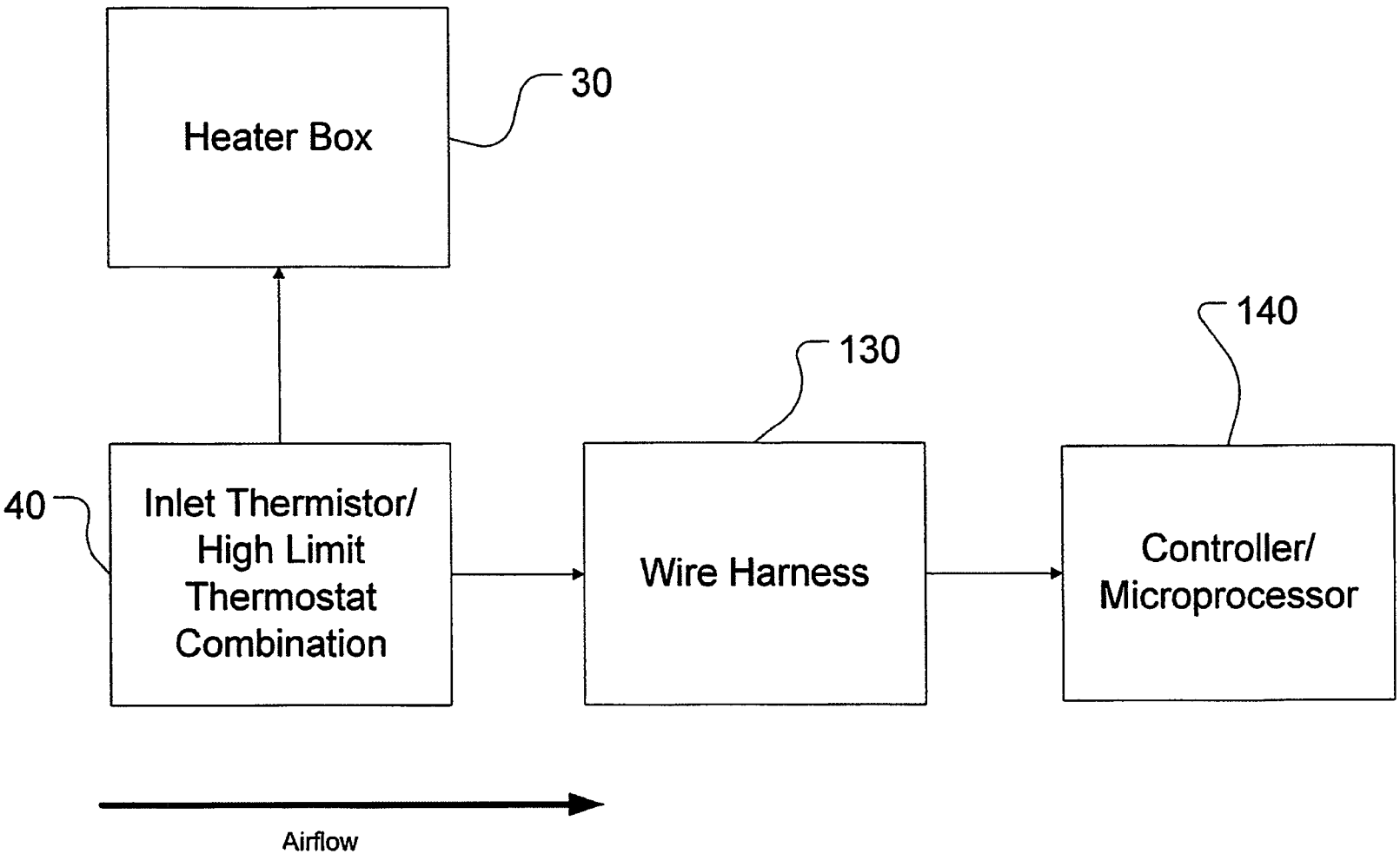
FIG. 3 is a control diagram of the system utilizing the combined thermistor/thermostat sensor of the present invention.

With reference to FIG. 3, the combined sensor 40 is connected to both the heating element 36 and a controller 140. Specifically, the thermostat 42 reacts to the inlet temperature to limit the heat input by the system. In the event that the thermostat's trip temperature is reached, the thermostat 42 would open the heating element circuit and turn the heating element 36 completely off.

Additionally, the thermistor 41 communicates with the controller 140 via a wire harness 130. The thermistor 41 measures the temperature at the inlet of the heater box 30, and then provides the temperature signal to the controller 140. When the thermistor 41 senses that the temperature is becoming too high, the controller 140 operates the heating element 36 at half power until an inlet reset point is reached. Thus, one of the heating elements 36 remains active and continues to heat the airflow. Once the reset temperature is reached, the controller 140 then turns the heating element 36 back to full power. Alternately, the combined thermistor/thermostat 40 could be implemented with a single stage heating element. As a result of this function of the thermistor, the thermostat is prevented from reaching its trip temperature, thus preventing long dry times due to thermostat cycling.

Figure 4:
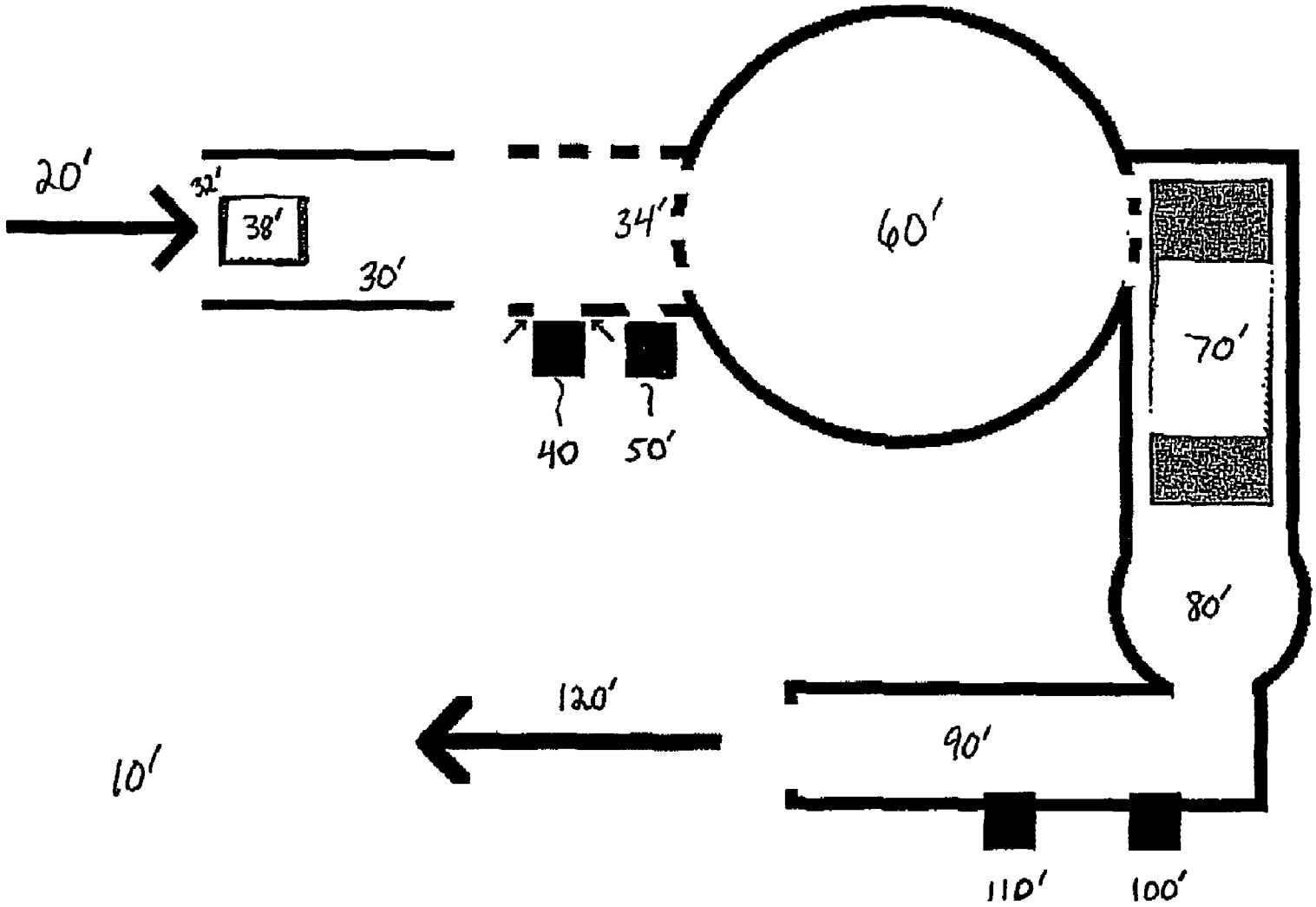
FIG. 4 is a schematic view of an alternative system utilizing the combined thermistor/thermostat sensor of the present invention.

With reference to FIG. 4, the combined sensor 40, described above, is shown in a gas dryer 10'. The gas dryer 10' is provided generally with a heater box 30', a drum 60', a blower 80' and an exhaust 90'. The heater box 30' is provided with an inlet 32' through which inlet airflow 20' passes, and a drum inlet grill 34' through which heated air exits the heater box 30' and enters the drum 60' of the dryer 10'. The air is heated in the heater box 30' by burner 38' that is controlled by a bi-level gas valve. The blower 80' draws the air out of the drum 60', through a lint screen 70', and eventually through the exhaust 90' of the dryer, as exhaust airflow 120'. The dryer 10' further includes a thermal cut-off 50' and a thermal fuse 110'. The thermal cut-off 50' ensures a safe condition in the event of a burner or gas valve failure. The thermal fuse 110' removes power to the drum motor, thus stopping the airflow and containing any combustible material from being vented outside of the dryer.

The gas dryer 10' is provided with a number of sensors for detecting the temperature of the airflow in the dryer. A combined thermistor/thermostat unit 40 is located in the inlet 32' of the heater box 30' while an exhaust thermistor temperature sensor 100' is located in the exhaust 90' of the dryer 10'. As shown in FIGS. 2A and 2B, the combined thermistor/thermostat unit 40 includes a thermistor temperature sensor 41 and an electromechanical bi-metal thermostat 42. The thermistor 41 measures the inlet air temperature of the dryer, and the exhaust thermistor 100' measures the temperature of exhaust airflow 120'. The thermostat 42 opens the gas valve when the temperature exceeds a predetermined trip point and closes the gas valve when the temperature falls below a predetermined reset point.

The function of the combined sensor 40 in the gas dryer 10' is generally the same as demonstrated above for an electric dryer 10. Referring again to FIG. 3, the thermistor 41 communicates with the controller 140 via a wire harness 130. The thermistor 41 measures the temperature at the inlet of the heater box 30', and then provides the temperature signal to the controller 140. When the thermistor 41 senses that the temperature is becoming too high, the controller 140 operates the burner 38' at half power until an inlet reset point is reached. Once the reset temperature is reached, the controller 140 then turns the burner 38' back to full power. As a result of this function of the thermistor, the thermostat is prevented from reaching its trip temperature, thus preventing long dry times due to thermostat cycling.

Thus, the present invention provides a more real-time control of the overall dryer temperature, thereby preventing the temperature from getting too high and damaging clothes, and also reducing nuisance cycling in the dryer. Further, dryness accuracy and overall energy efficiency of the dryer are both improved.

The combined sensor of the present invention can be manufactured at a cost lower than that of prior art sensors since the thermistor and thermostat are assembled as a single piece instead of two separate components.

While certain features and embodiments of the present invention have been described in detail herein, it is to be understood that the invention encompasses all modifications and enhancements within the scope and spirit of the following claims.

We claim:

1. A system for regulating the inlet air temperature in a dryer, comprising:

a temperature sensor located in an inlet of a dryer, the temperature sensor comprising:

a body;

a thermostat within the body; and a thermistor within the body, the thermistor measuring the air temperature at the inlet of the dryer;

a heat source located adjacent the temperature sensor, wherein the thermostat limits the inlet air temperature by cycling the heat source when the inlet air temperature reaches a trip temperature; and a controller that communicates with the thermistor to prevent the thermostat from reaching its trip temperature.

2. The system of claim 1 wherein the heat source is a heating element.

3. The system of claim 2 wherein the heating element is a dual element heater.

4. The system of claim 1 wherein the heat source is a burner.

5. The system of claim 1 wherein the thermostat is a bi-metal thermostat.

6. The system of claim 1 further comprising a heater box in which the heat source is contained, the temperature sensor being positioned at an inlet of the heater box.

7. A clothes dryer comprising a system for regulating the inlet air temperature, the dryer including a drum holding clothes to be dried, the system comprising:

an inlet duct for receiving inlet airflow;

a temperature sensor located in the inlet duct of the dryer and measuring the air temperature in the inlet duct, the temperature sensor comprising:

a body;

a thermistor within the body; and a thermostat within the body;

a heat source located in a heater box positioned in the inlet duct between the temperature sensor and the drum;

a blower for drawing air out of the drum;

an exhaust duct located adjacent the blower for receiving the air from the blower and directing the airflow out of the dryer; and a controller for receiving the inlet air temperature measurement from the thermistor, wherein the controller operates the heat source to prevent the thermostat from reaching its trip temperature.

8. The system of claim 7 wherein the heat source is a heating element.

9. The system of claim 8 wherein the heating element is a dual element heater.

10. The system of claim 7 wherein the heat source is a burner.

11. The system of claim 7 wherein the thermostat is a bi-metal thermostat.

12. The system of claim 7 wherein the temperature sensor is positioned at an inlet of the heater box.

13. A method for regulating the inlet air temperature in a clothes dryer, the dryer including an inlet for receiving an airflow, a temperature sensor located in the inlet for sensing an inlet air temperature, the temperature sensor comprising a body with a thermistor and a thermostat therein, a heat source located adjacent the temperature sensor, and an exhaust for directing the airflow of the dryer, the method comprising:

generating an inlet temperature signal with the thermistor of the temperature sensor corresponding to the inlet air temperature in the inlet of the dryer;

providing the inlet temperature signal to a controller;

controlling the amount of heat provided by the heat source based on the inlet temperature signal; and preventing the thermostat of the temperature sensor from reaching its trip temperature by controlling the amount of heat provided by the heat source.

14. The method of claim 13 wherein the step of generating includes measuring conductive, convective, and radiated heat from the heat source.

15. The method of claim 13 wherein the step of generating includes measuring convective and radiated heat from the heat source.

16. The method of claim 13 wherein the controlling step occurs before the thermostat reaches its trip temperature.

17. The method of claim 13 wherein the controlling step further comprises operating the heat source at half power until a reset temperature is reached.

* * * * *